United States Patent [19]

Maeda

[11] 4,382,009

[45] May 3, 1983

[54] HYDRAULIC FLUID CONTAINING WATER AND AN α,ω-POLYBUTADIENEDICARBOXYLIC ACID

[75] Inventor: Rikuzo Maeda, Amagasaki, Japan

[73] Assignee: Matsumura Oil Research Corporation, Nishinomiya, Japan

[21] Appl. No.: 265,078

[22] Filed: May 19, 1981

[30] Foreign Application Priority Data

Dec. 3, 1980 [JP] Japan ..... 55-171388

[51] Int. Cl.[3] ..... C09K 5/00

[52] U.S. Cl. ..... 252/79; 252/49.3; 252/56 R; 252/56 D; 252/77

[58] Field of Search ..... 252/32, 49.3, 33.4, 252/56 R, 56 D, 77, 79; 525/244; 528/271

[56] References Cited

U.S. PATENT DOCUMENTS

| | | | |
|---|---|---|---|
| 2,422,278 | 6/1947 | Young et al. | 252/56 D X |
| 3,231,498 | 1/1966 | de Vries | 252/56 |
| 3,288,714 | 11/1966 | Osuch | 252/57 |
| 3,329,613 | 7/1967 | Fischer et al. | 252/59 |
| 4,077,893 | 3/1978 | Kiovsky | 252/56 R |
| 4,082,817 | 4/1978 | Imaizumi et al. | 525/285 X |
| 4,161,452 | 7/1979 | Stambaugh et al. | 252/34 |
| 4,225,447 | 9/1980 | Law et al. | 252/34.7 |

*Primary Examiner*—P. E. Willis, Jr.

*Attorney, Agent, or Firm*—Armstrong, Nikaido, Marmelstein & Kubovcik

[57] ABSTRACT

A hydraulic fluid comprising an oil and at least one butadine derivative selected from the group consisting of α,ω-polybutadienedicarboxylic acid, maleinized polybutadiene, hydrogenated α,ω-polybutadienedicarboxylic acid, and hydrogenated and maleinized polybutadiene.

2 Claims, No Drawings

HYDRAULIC FLUID CONTAINING WATER AND AN α,ω-POLYBUTADIENEDICARBOXYLIC ACID

This invention relates to a hydraulic fluid chiefly for use in hydraulic systems, and more particularly to a hydraulic fluid which is also usable as a water-containing fire-resisting hydraulic fluid.

To prevent fire accidents, water-containing fire-resisting hydraulic fluids, especially those with high water contents, are usually used for hydraulic systems for iron and steel rolling mills, die casting machines, etc. which handle articles at high temperatures. The cutting oils or grinding oils specified by JIS-K-2241 are at present commercially available as such hydraulic fluids having high water contents. However, these commercial hydraulic fluids are originally water-soluble cutting or grinding oils and have inferior lubricating properties for use as hydraulic oils. Although research is under way to give them satisfactory lubricating properties as hydraulic fluids, the efforts so far made have not matured to fully successful results. Moreover, none of the hydraulic fluids heretofore developed are compatible with the material of hydraulic devices and systems or free from pollutants.

An object of the present invention is to provide a water-containing hydraulic fluid having outstanding lubricating properties.

Another object of the invention is to provide a water-containing hydraulic fluid having outstanding lubricating properties and which is also highly compatible with the material of hydraulic devices and systems.

Another object of the invention is to provide a hydraulic fluid having outstanding lubricating properties, highly compatible with the material of hydraulic devices or systems and involving greatly reduced likelihood of causing environmental pollution.

Still another object of the invention is to provide a water-containing hydraulic fluid which exhibits excellent performance when used for hydraulic systems in the field in which high-temperature articles are handled.

These objects and other features of the invention will become apparent from the following description.

The foregoing objects of the present invention are fulfilled by incorporating into an oil at least one polybutadiene derivative selected from the group consisting of α,ω-polybutadienedicarboxylic acid, maleinized polybutadiene, hydrogenated and maleinized polybutadiene, and hydrogenated α,ω-polybutadienedicarboxylic acid.

Our research has revealed the novel finding that when a specific compound, namely the above butadiene derivative, is incorporated into a mineral oil or synthetic oil which is generally used as the base for lubricating oils, the resulting oil is outstanding in lubricating properties, highly compatible with the material of hydraulic devices or systems and almost unlikely to cause environmental pollution, even if diluted with water to a great extent. The invention has been accomplished based on this novel finding.

α,ω-Polybutadienedicarboxylic acid to be used in this invention is obtained by introducing a carboxyl group into each end of liquid atactic 1,2-polybutadiene which is prepared by subjecting butadiene to living polymerization. The average molecular weight of the acid is preferably about 500 to about 4000, more preferably 1000 to 2000, or most preferably 1000 to 1500. The α,ω-polybutadienedicarboxylic acid is preferably of the acid type but may be used as partially or wholly neutralized. For neutralization, alkali metal hydroxides, organic amines are usually used.

Maleinized polybutadiene to be used in this invention is prepared by maleinizing atactic 1,2-polybutadiene with maleic acid anhydride. The maleinized polybutadiene has an average molecular weight of about 1000 to 6000, more preferably about 1000 to 3000, or most preferably about 1000 to 2000.

The maleinization is conducted by the usual manner. In this invention, hydrogenated α,ω-polybutadienedicarboxylic acid and hydrogenated and maleinized polybutadiene are also usable. Each of these compounds is prepared by hydrogenating α,ω-polybutadienedicarboxylic acid or maleinized polybutadiene. The hydrogenation is conducted in an usual manner.

The oils in which the butadiene derivative is to be incorporated are mineral oils and synthetic oils which are usually used as bases for lubricating oils. Examples of useful mineral oils are those having a viscosity of about 15 to 50 cst (40° C.) such as neutral oil or machine oil. Exemplary of useful synthetic oils are polyolefin oil, polyglycohol oil and aliphatic acid polyol ester oil.

The amount of the butadiene derivative to be admixed with the oil is about 1 to about 60% by weight, preferably about 1 to about 30% by weight, based on the working fluid obtained. With the acid present in an amount outside this range, there is the tendency that the working fluid has a larger viscosity and the object of this invention is not accomplished.

The working fluid of this invention is usable as it is without dilution or as diluted to a suitable concentration. Generally it is preferable to use the fluid as diluted with water to such a concentration that the resulting dilution contains about 0.1 to about 5% by weight of the butadiene derivative. The fluid may be diluted into an emulsion or a solution.

With the present invention, as is the case with usual water-soluble cutting oils, the hydraulic fluid is prepared first in the form of a concentrate, which is then diluted with water by stirring to a butadiene derivative concentration of 1 to 10% suited for use. It is desirable to dilute the concentrate with water preferably two- or three-fold and treat the dilution by an emulsifying device to prepare an emulsion comprising munite particles, which is further diluted when placed into use.

When desired, surfactants, corrosion inhibitors, preservatives, pH adjusting agents, thickeners, etc. can be added to the hydraulic fluid of the invention. Suitable surfactants are anionic and nonionic surfactants which are generally used for water-soluble cutting oils. A desirable surfactant should be selected preferably in view of the stability of the fluid and ease of treatment of the effluent. Examples of useful surfactants are alkali metal salts or amine salts of fatty acid having carbon atoms of 12 to 22, an anionic surfactant such as alkyl sulfate, synthetic sulfonate, petroleum sulfonate, nonionic surfactant such as polyoxyethylenesulbitanemonooleate, polyoxyethylenelaulate, polyoxyethylenenonylphenylether. Suitable corrosion inhibitors are those commercially available for inhibiting the corrosion of iron, and benzotriazole and other inhibitors for copper. Useful preservatives and thickeners are various water-soluble polymers, such as polyethylene glycol, polypropylene glycol, copolymer of ethyleneoxide and propyleneoxide. Suitable pH adjusting agents are those heretofore used, such as monoethanol amine, diethanol amine, triethanol amine, morphorine, cyclohexyl amine.

These additives may be admixed with the composition of the invention, i.e. the mixture of an oil and α,ω-polybutadienedicarboxylic acid, before or after the mixture is diluted with water, or simultaneously when it is diluted. The additives are used in amounts which are widely variable suitably.

The present invention will be described with reference to the following examples.

EXAMPLES 1-6

Hydraulic fluid compositions are prepared from the ingredients listed in Table 1 below, namely α,ω-polybutadienedicarboxylic acid (trade mark "NISSO PBC 1000," product of Nihon Soda Co., Ltd., Japan), neutral oil, fatty acid ester oil, water, commercial corrosion inhibitor, commercial water-soluble thickener, pH adjusting agents, surfactant and commercial preservative.

EXAMPLE 7-8

Hydraulic fluid compositions are prepared in the same manner as in Example 1 except that hydrogenated α,ω-polybutadienedicarboxylic acid (NISSO PBCI 1000) and maleinized polybutadiene [(NISSO PBBN 1015), Example 8] are used in place of α,ω-polybutadienedicarboxylic acid.

TABLE 1

| Ingredient (parts by weight) | Example 1 | 2 | 3 | 4 | 5 | 6 | 7*1 | 8*2 |
|---|---|---|---|---|---|---|---|---|
| NISSO PBC 1000 | 10 | 5 | 20 | 20 | 5 | 5 | 10 | 10 |
| Neutral oil | 10 | 10 | | | 10 | 10 | 10 | 10 |
| Ester oil | 10 | 10 | 20 | 20 | 10 | 10 | 10 | 10 |
| Water | 55 | 60 | 50 | 0 | 65.5 | 60.5 | 55 | 55 |
| Corrosion inhibitor | 10 | 10 | 5 | 5 | 5 | 5 | 10 | 10 |
| Benzotriazole | 1 | 1 | | | 0.5 | 0.5 | 1 | 1 |
| Thickener | | | | | | 5 | | |
| Diethanolamine | | | 0.5 | 0.5 | | | | |
| Triethanolamine | 0.4 | 0.4 | | | | | | |
| Oleic acid | 0.7 | 0.7 | 1.5 | 1.5 | | | | |
| Nonionic surfactant | 2 | 2 | 2 | 2 | 4 | 4 | 4 | 4 |
| Preservative | 1 | 1 | 1 | 1 | 1 | 1 | 1 | 1 |

*1NISSO PBCI 1000 is used.
*2NISSO PBBN 1015 is used.

TEST EXAMPLE 1

The compositions prepared in Examples 1 to 8 are diluted with water and agitated to obtain emulsified hydraulic fluids having high water contents and the α,ω-polybutadienedicarboxylic acid (abbreviated as "PBC") concentrations listed in Table 2. The hydraulic fluids are tested for abrasion resistance using a vane pump as specified by ASTM D 2882 for testing hydraulic working fluids. The pump is operated at pressure of 5 MPa at a temperature of 40° C. The amounts of wear on pump components are measured. Table 2 shows the results.

Steel, copper, aluminum, zinc and brass pieces are immersed in the water-containing hydraulic fluids prepared as above with use of the compositions of Examples 1, 3 and 5 and allowed to stand at a temperature of 50° C. for 168 hours. The resulting variation in the weight of each metal piece is thereafter measured. Table 3 shows the results.

TABLE 2

| | Example 1 | 2 | 3 | 4 | 5 | 6 | 7 | 8 | Comp. Ex. Cutting oil[1] | Comp. Ex. Working fluid[2] |
|---|---|---|---|---|---|---|---|---|---|---|
| PBC concentration (%) | 1 | 0.25 | 2 | 4 | 0.5 | 0.5 | — | — | 5.0[3] | 2.5[3] |
| PBCI-1000 concentration (%) | — | — | — | — | — | — | 1 | — | — | — |
| PBBN-1015 concentration (%) | — | — | — | — | — | — | — | 1 | — | — |
| pH | 7.6 | 7.4 | 7.0 | 7.0 | 8.2 | 8.2 | 8.0 | 8.0 | 9.0 | 9.8 |
| Kinetic viscosity (cst/40° C.) | 0.88 | 0.80 | 0.88 | 1.2 | 0.8 | 3.0 | 0.82 | 0.85 | 0.88 | 0.82 |
| Amount of wear (mg) Cam ring | 64 | 88 | 28 | 24 | 190 | 120 | 48 | 96 | 2450 | 1920 |
| Vane | 44 | 60 | 40 | 30 | 80 | 71 | 38 | 62 | 340 | 84 |

Note:
[1]Commercial cutting oil
[2]Commercial hydraulic fluid ("Hydrolubric 120", the product of Huughton Co.)
[3]Concentration of the components other than water.

TABLE 3

| Variation of weight (mg/cm²) | Example 1 | 3 | 5 | Comparison Example Commercial cutting oil | Comparison Example Commercial hydraulic fluid* |
|---|---|---|---|---|---|
| Steel | −0.01 | −0.01 | 0.00 | −0.01 | −0.01 |
| Copper | 0.00 | 0.00 | −0.02 | −0.06 | −0.04 |
| Brass | 0.00 | 0.00 | −0.01 | −0.11 | −0.07 |
| Aluminum | +0.01 | +0.01 | −0.01 | −0.30 | −0.04 |
| Zinc | +0.01 | −0.03 | −0.05 | −0.50 | −0.86 |

Note:
*The same hydraulic fluid as in Table 2.

TEST EXAMPLE 2

Assuming that the hydraulic fluid leaking from a hydraulic system becomes mingled with an industrial effluent, the composition of Example 1 is diluted tenfold, and the dilution is subjected to waste water treatment.

One part of 20% aqueous solution of PAC is added to 100 parts of the dilution (white turbid emulsion), and the mixture is neutralized with 5% aqueous suspension of calcium hydroxide to a pH of 7 with stirring. With addition of one part of 1% aqueous solution of a high-molecular-weight coagulant, the mixture is allowed to stand and thereafter filtered with No. 2 filter paper.

The liquid filtered becomes transparent but remains colorless. The COD of the filtrate is 25 ppm.

I claim:

1. A hydraulic fluid comprising an aqueous emulsion or solution of an oil suitable for use as the base for a lubricating oil and selected from the group consisting of a mineral oil and a synthetic oil, and an $\alpha,\omega$-polybutadienedicarboxylic acid having an average molecular weight of about 1,000 to about 1,500, the amount of the $\alpha,\omega$-polybutadienedicarboxylic acid being about 0.1 to about 5% by weight based on the weight of the hydraulic fluid.

2. The hydraulic fluid of claim 1 wherein the amount of the $\alpha,\omega$-polybutadienedicarboxylic acid is about 1 to about 60% by weight based on the weight of the oil.

* * * * *